US006155238A

United States Patent [19]

Briggs et al.

[11] Patent Number: 6,155,238

[45] Date of Patent: Dec. 5, 2000

[54] FUEL PRESSURE REGULATOR AND FUEL FILTER MODULE

[75] Inventors: Paul F. Briggs, Wolcott; Geroge H. Bucci, Southington, both of Conn.; David R. Mroczka, Port Washington, N.Y.

[73] Assignee: Walbro Corporation, Cass City, Mich.

[21] Appl. No.: 09/283,404

[22] Filed: Apr. 1, 1999

[51] Int. Cl.[7] ..... F02M 37/04

[52] U.S. Cl. ..... 123/509; 123/510; 123/457

[58] Field of Search ..... 123/509, 514, 123/457, 510–511

[56] References Cited

U.S. PATENT DOCUMENTS

| | | | |
|---|---|---|---|
| 5,195,494 | 3/1993 | Tuckey | 123/514 |
| 5,392,750 | 2/1995 | Laue et al. | 123/509 |
| 5,433,241 | 7/1995 | Robinson . | |
| 5,511,957 | 4/1996 | Tuckey et al. | 417/313 |
| 5,520,156 | 5/1996 | Brunnhofer . | |
| 5,649,514 | 7/1997 | Okada et al. | 123/514 |
| 5,699,773 | 12/1997 | Kleppner et al. | 123/510 |
| 5,758,627 | 6/1998 | Minagawa et al. | 123/509 |
| 5,762,047 | 6/1998 | Yoshioka et al. | 123/509 |
| 5,769,061 | 6/1998 | Nagata et al. | 123/509 |
| 5,782,223 | 7/1998 | Yamashita et al. | 123/509 |
| 5,785,032 | 7/1998 | Yamashita et al. | 123/509 |
| 5,908,020 | 6/1999 | Boutwell et al. | 123/509 |
| 6,014,957 | 1/2000 | Robinson | 123/509 |
| 6,029,633 | 2/2000 | Brandt | 123/509 |

*Primary Examiner*—Thomas N. Moulis

*Attorney, Agent, or Firm*—Reising, Ethington, Barnes, Kisselle, Learman & McCulloch, P.C.

[57] ABSTRACT

A fuel pressure regulator and fuel filter module constructed to be connected to a vehicle fuel tank has a body with an integral, radially extending flange constructed to overlie and to be attached to the fuel tank and an integral depending skirt constructed to contain a fuel filter and to define in part an integral fluid passage communicating a fuel pump through the filter with a fuel line attached at one end to the module and through which fuel is delivered to an operating engine. Fuel discharged from the fuel pump flows through the fuel filter before entering the fuel line for delivery to the engine. An inlet of the fuel pressure regulator communicates with the fuel downstream of the fuel filter to bypass excess fuel delivered from the fuel pump through a bypass outlet of the regulator and into the fuel tank. Forming the module with the skirt, fluid passage and mounting flange in an integral, one-piece body of a plastic material substantially eliminates the escape of fuel vapors from the module because there are no seals or connections between separate bodies, as in previous modules, through which fuel vapors may permeate and escape to the atmosphere. Further, the one-piece module is stronger and is more durable during a vehicle crash than are multiple-piece modules which reduces the likelihood that fuel will leak from the fuel tank adjacent the module or through the module during or after such a crash.

21 Claims, 2 Drawing Sheets

FUEL PRESSURE REGULATOR AND FUEL FILTER MODULE

FIELD OF THE INVENTION

This invention relates generally to fuel systems and more particularly to a fuel pressure regulator and fuel filter module adapted to be mounted to a fuel tank.

BACKGROUND OF THE INVENTION

Fuel pressure regulators have been disposed in various portions of vehicle fuel delivery systems to regulate the pressure of fuel delivered to an operating engine. In return type fuel systems, a fuel pressure regulator is typically disposed downstream of the engine fuel injectors and often on the engine fuel rail and fuel delivered in excess of the engine's fuel demand is returned by the fuel pressure regulator to the fuel tank through a return fuel line. In "return less" or no return type fuel systems, a fuel pressure regulator is disposed upstream of the engine and usually within the fuel tank immediately downstream of the fuel pump to bypass excess fuel delivered from the fuel pump into the fuel tank.

Fuel filters may be disposed downstream of the fuel pump as well to remove contaminants from the fuel delivered to the engine. Generally, fuel flow through the filter results in a pressure loss the magnitude of which increases as the fuel filter becomes increasingly clogged during use. Thus, it is preferable to regulate the pressure of the fuel downstream of any in-line fuel filter to remove the affects of the fuel filter on the pressure of fuel supplied to the engine.

One fuel system, as disclosed in U.S. Pat. No. 5,520,156, disposes an annular fuel filter in a depending skirt of a body attached to the fuel tank such that the fuel filter is immediately downstream of the fuel pump and the fuel delivered from the fuel pump flows through the fuel filter before being discharged from the fuel tank to an engine through a fuel line. In this fuel system, a fuel line connector and filter housing cap is removably received in the body and releasably retained by a ring threadably received on the body.

U.S. Pat. No. 5,433,241 discloses a module mounted on a fuel tank with an outer body receiving a fuel pressure regulator downstream of a fuel pump in the fuel tank. An inner body having an outlet through which fuel flows to a fuel line for delivery to the engine is disposed within the outer body to enclose a fuel filter therein. The inner body is press fit into the outer body with an O-ring between them to provide a seal.

Despite disposing one or more O-rings between the various members of these multiple piece assemblies, fuel vapors permeate the seals and escape from the fuel tank through the assemblies. The leaking hydrocarbon fuel vapors are hazardous to the environment and unacceptable under increasingly strict governmental regulations. Further, the multiple piece assemblies have a reduced strength and are subject to leaking liquid fuel as well as fuel vapors upon impact, such a during a vehicle accident.

SUMMARY OF THE INVENTION

A fuel pressure regulator and fuel filter module constructed to be connected to a vehicle fuel tank has a body with an integral, radially extending flange constructed to overlie and to be attached to the fuel tank and an integral depending skirt constructed to contain a fuel filter and to define in part an integral fluid passage communicating a fuel pump through the filter with a fuel line attached at one end to the module and through which fuel is delivered to an operating engine. An inlet of the fuel pressure regulator communicates with the fuel downstream of the fuel filter to bypass excess fuel delivered from the fuel pump through a bypass outlet of the regulator and into the fuel tank. Forming the module with the skirt, fluid passage and mounting flange in an integral, one-piece body substantially eliminates the escape of fuel vapors from the module because there are no seals or connections between separate bodies, as in previous modules, through which fuel vapors may permeate and escape to the atmosphere. Further, the one-piece module is stronger and is more durable during a vehicle crash than are multiple-piece modules to reduce the likelihood that fuel will leak from the fuel tank adjacent the module or through the module during or after such a crash.

Objects, features and advantages of this invention include providing a one-piece fuel filter and fuel pressure regulator module which reduces the escape of hydrocarbon vapors into the atmosphere, has increased strength over previous modules, is less likely to permit fuel to leak between the module and the fuel tank after a vehicle accident, provides improved filtration of fuel delivered to the vehicle engine, controls the flow of fuel to the engine corresponding to the engine's fuel demand, regulates the pressure downstream of the fuel filter to ensure that the fuel supply to the engine is regulated independently of the filter and is of relatively simple design and economic manufacture and assembly, is rugged, durable, reliable and has a long and useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
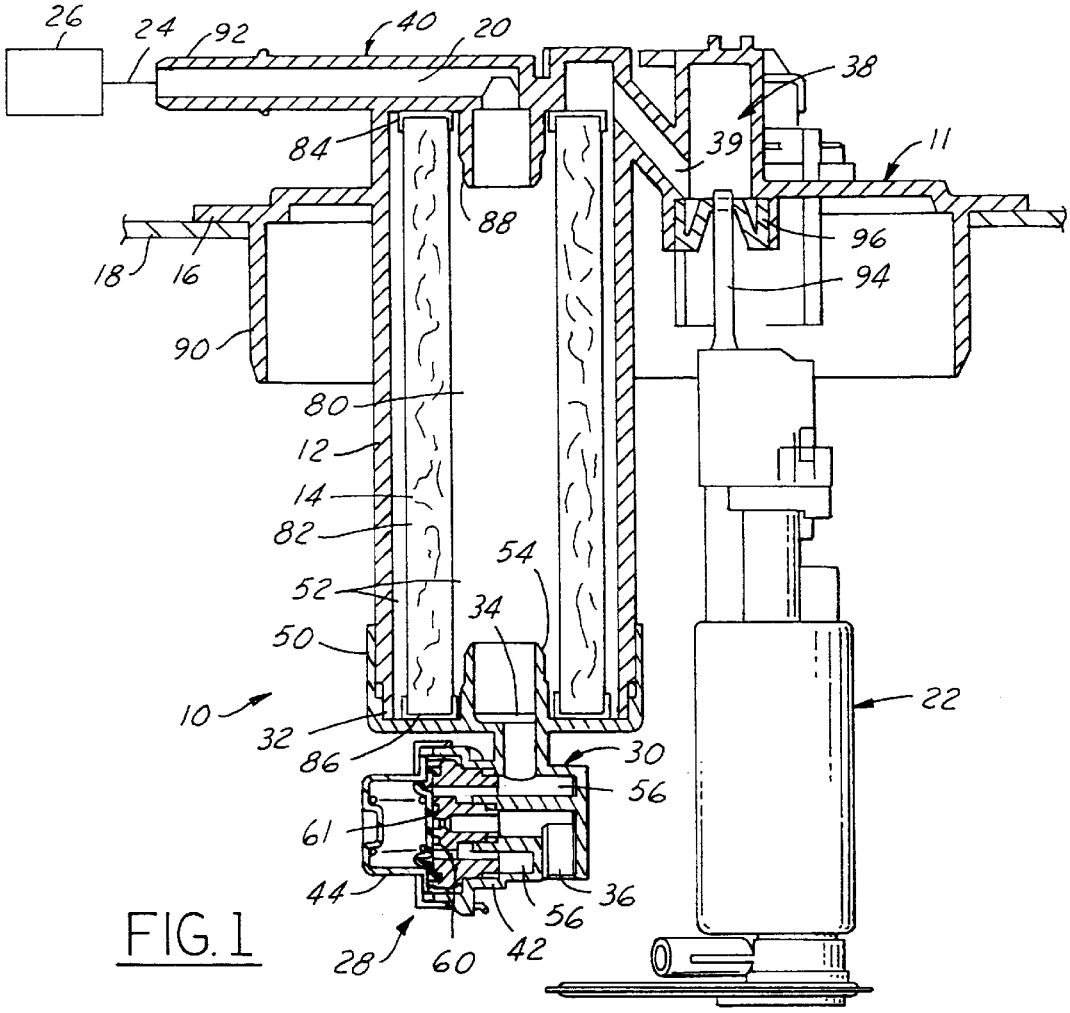
FIG. 1 is a cross sectional view of a fuel filter and fuel pressure regulator module embodying the invention.

Referring in more detail to the drawings, FIG. 1 illustrates a fuel pressure regulator and fuel filter module 10 having a body 11 with an integral depending skirt 12 constructed to contain an annular filter 14 and an integral radially extending mounting flange 16 constructed to be welded or otherwise sealed to a fuel tank 18. The module 10 also has an integral fuel supply passage 20 formed in the body 11 which communicates pressurized fuel delivered from a fuel pump 22 with a fuel line 24, through which fuel is delivered to an engine 26, through the fuel filter 14 received in the skirt 12. A fuel pressure regulator 28 is carried by a separate housing 30 received within the fuel tank 18 and attached to the open end 32 of the skirt 12 retaining the fuel filter 14 therein. The housing 30 has an inlet 34 in communication with the fuel in the skirt 12 downstream of the filter 14 and a bypass outlet 36 through which fuel supplied from the fuel pump 22 in excess of the engine's fuel demand is returned to the fuel tank 18. Fuel delivered from the fuel pump 22 flows into an inlet portion 38 and a passage 39 which routes the fuel to the exterior of the fuel filter 14 within the skirt 12. The fuel which flows through the fuel filter 14 is communicated with both the inlet 34 of the housing 30 and an outlet portion 40 of the fuel supply passage 20 for delivery through the fuel line 24 to the engine 26 according to the engine's fuel demand.

Figure 2:
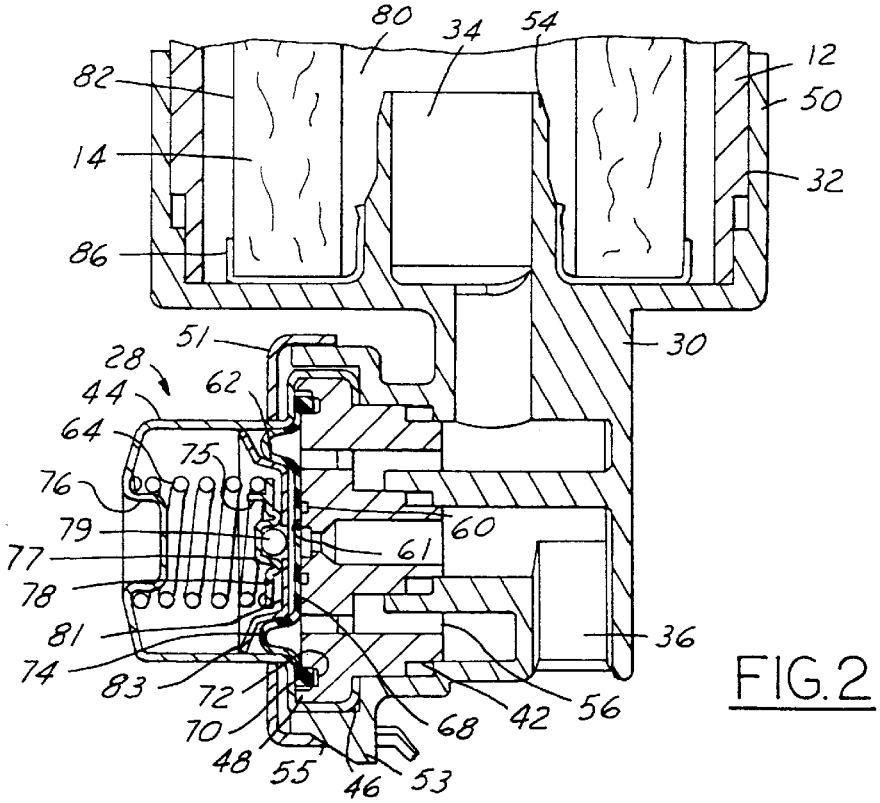
FIG. 2 is a cross sectional view of a suitable regulator for the module of FIG. 1.

As shown in more detail in FIG. 2, the housing 30 has an annular rim 50 constructed to be press-fit onto the lower end 32 of the skirt 12 to define an enclosure 52 and to provide a liquid-tight seal between the housing 30 and the skirt 12. An inner annular projection 54 of the housing 30 extends into the enclosure 52 defined between the skirt 12 and the regulator 28 and defines in part the fuel inlet 34. The regulator fuel inlet 34 communicates fuel within the fuel filter 14 with an annular chamber 56 defined by the housing 30 and the body 42 surrounding the bypass outlet 36.

The fuel pressure regulator 28 has a body 42 and a cap 44 secured to the body 42 by rolling a peripheral edge 46 of the cap 44 around a radially extending flange 48 of the body 42. The body 42 is press-fit into the housing 30 and an annular retainer 51 is received over the cap 44 and snap-fit onto the housing 30 with two or more circumferentially spaced projections 53 of the housing 30 received in complimentary openings 55 in the retainer 51 to retain the regulator 28 adjacent the housing 30.

An annular groove 60 formed in the body 42 defines an annular valve seat 61 surrounding the bypass outlet 36. A diaphragm 62 is yieldably biased by a spring 64 onto the valve seat 61 of the body 42 to prevent fuel flow through the bypass outlet 36 when the diaphragm is seated. The diaphragm 62 has a relatively thin and flexible central portion 68 and a circumferentially continuous peripheral rib 70 received in a groove 72 in the body 42 and retained therein by the overlying cap 44. Thus, the diaphragm 62 defines in part the annular chamber 56 and the pressurized fuel within the chamber 56 acts on the diaphragm 62 against the bias of the spring 64. Preferably, to provide a more flexible and responsive diaphragm 62, it has a circumferentially continuous pleat or bellows 74.

A circular depression 76 in the cap 44 is constructed to retain one end of the spring 64. The other end of the spring 64 is received on a retainer 78 having several up-turned tabs 75 received adjacent the spring 64 to hold the spring 64 on the retainer 78. The retainer 78 has a pocket 77 in which is received a ball 79 which transmits the force of the spring 64 to the diaphragm 62 through a cup 81. The transmission of the spring force to the diaphragm through the ball 79 and cup 81 permits the diaphragm to pivot relative to the retainer 78 and spring 64 and improves the performance of the regulator. The cup 81 has a radially outwardly extending rim 83 which engages the cap 44 to limit the lateral movement of the diaphragm 62. Although described herein as shown, the regulator 28 may be of substantially any construction capable of bypassing fuel delivered from the fuel pump in excess of the engine's fuel demand.

The regulator 28 is responsive to the pressure of fuel downstream of the filter 14 via the regulator fuel inlet 34 which communicates with the interior 80 of the annular filter 14. At least a portion of the fuel which flows through the filter 14 enters the fuel pressure regulator 28 through the regulator fuel inlet 34, flows into the annular chamber 56 and acts on the diaphragm 62 against the bias of the spring 64. When the force exerted on the diaphragm 62 by the fuel in the annular chamber 56 is greater than the opposing force of the spring 64 acting on the diaphragm 62, the diaphragm 62 is displaced from the valve seat 61 to return fuel to the fuel tank 18 through the bypass outlet 36.

Typically, the fuel pump 22 delivers a substantially constant flow rate of fuel which is sufficient to supply the maximum fuel demand of the engine 26. Thus, when the engine 26 has a low fuel demand, such as when the engine 26 is idling, the fuel pump 22 is supplying a substantially greater amount of fuel than is being consumed by the engine 26 and hence a significant pressure of fuel acts on the diaphragm 62 to displace the diaphragm 62 from the valve seat 61 and bypass a significant flow rate of the fuel to the fuel tank 18. When the engine 26 has a high fuel demand and is hence, consuming most of the fuel supplied by the fuel pump 22, the diaphragm 62 is displaced a lesser amount to return a lower flow rate of fuel to the fuel tank 18. By bypassing excess fuel, the fuel pressure regulator 28 can provide a pressure of fuel delivered to the engine 26 which is essentially constant over a wide range of fuel flow rates to the engine 26.

The fuel filter 14 is annular and has a generally cylindrical wall 82 formed of a suitable, porous filter material and upper and lower annular retaining members 84, 86 attached to opposed ends of the wall 82. To locate and retain the upper end of the filter, the upper retaining member 84 is received over an annular depending projection 88 of the module 10 before the regulator 28 is assembled onto the skirt 12. When the housing 30 is press-fit onto the skirt 12, the projection 54 of the regulator body 42 is received in the lower retaining member 86 to locate and retain the lower end of the filter 14.

The module body 11 has a depending annular rim 90 constructed to be received within an opening in the fuel tank 18 with the integral radially extending mounting flange 16 constructed to overlie and to be fixed and sealed to the fuel tank 18 adjacent to the opening. The module also defines the fuel supply inlet portion 38 and passage 39 communicating the fuel pump 22 with the outer periphery of the fuel filter 14 in the skirt 12 and the outlet portion 40 communicating the interior of the filter 14 with the fuel supply passage 20 and the fuel line 24 press-fit onto a free end 92 of the outlet portion 40 which is disposed exteriorly of the fuel tank 18. Thus, the skirt 12, mounting flange 16, fuel supply passage 20 and fuel inlet 38, 39 are integrally formed in the module 10.

An outlet 94 of the fuel pump 22 is press fit into a retainer 96 adjacent the inlet portion 38 of the fuel supply passage to provide a substantially liquid-tight seal between the fuel pump outlet 94 and the module 10. Thus, the fuel pump outlet 94 communicates with the inlet portion 38 to deliver fuel through the inlet portion 38 and passage 39 to the exterior of the fuel filter 14 whereupon the fuel flows through the fuel filter 14 to remove at least some of the contaminants in the fuel. After flowing through the annular fuel filter 14, the fuel is communicated with the inlet 34 of the pressure regulator 28 which regulates the pressure of fuel delivered to the engine 26 according to the engine's fuel demand, as previously described. The fuel within the interior 80 of the filter 14 is also communicated with the outlet portion 40 of the fuel supply passage 20 which at one end is defined by the depending annular projection 88 and at its other end communicates with the fuel line 24 to deliver the filtered fuel to the engine 26.

The fuel pressure and fuel filter regulator module 10 has an integral flange 16 mounted directly to the fuel tank 18, an integral depending skirt 12 which contains the fuel filter 14 and which carries the fuel pressure regulator 28 and also has an integral fuel supply passage 20 communicating the fuel pump 22 with the operating engine 26 to reduce the permeation and escape to the atmosphere of fuel vapors through the module 10. Preferably the one-piece module 10 is molded of a plastic material such as acetal and its flange 16 is attached and sealed by a continuous weld or heat seal to the top wall of a fuel tank of a composite plastic laminate with an outer layer of a plastic material such as multilayer polyethylene and ethylene vinyl alcohol (EVOH).

The one-piece module 10 construction also provides greater strength than multiple-piece modules and has increased integrity during and after a vehicle collision to reduce the likelihood of fuel, as well as fuel vapors, from leaking through the module 10 or between the module 10 and the fuel tank 18. Further, the module 10 provides an increased surface area fuel filter 14 to improve the filtration of fuel delivered to the engine 26 and provides a fuel pressure regulator 28 downstream of the fuel filter 14 to prevent fuel pressure losses due to the flow of fuel through the fuel filter 14 from affecting the pressure of the fuel delivered to the engine 26.

Figure 4:
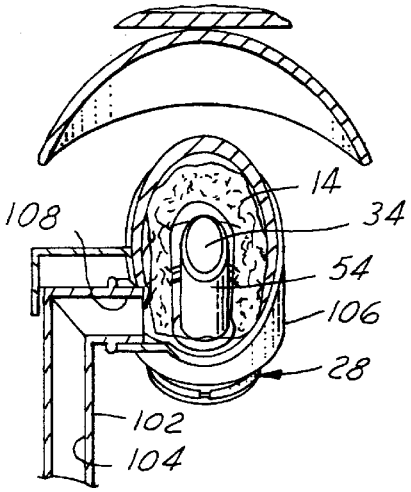
FIG. 4 is a sectional view taken along line 4—4 in FIG. 3.
Figure 3:
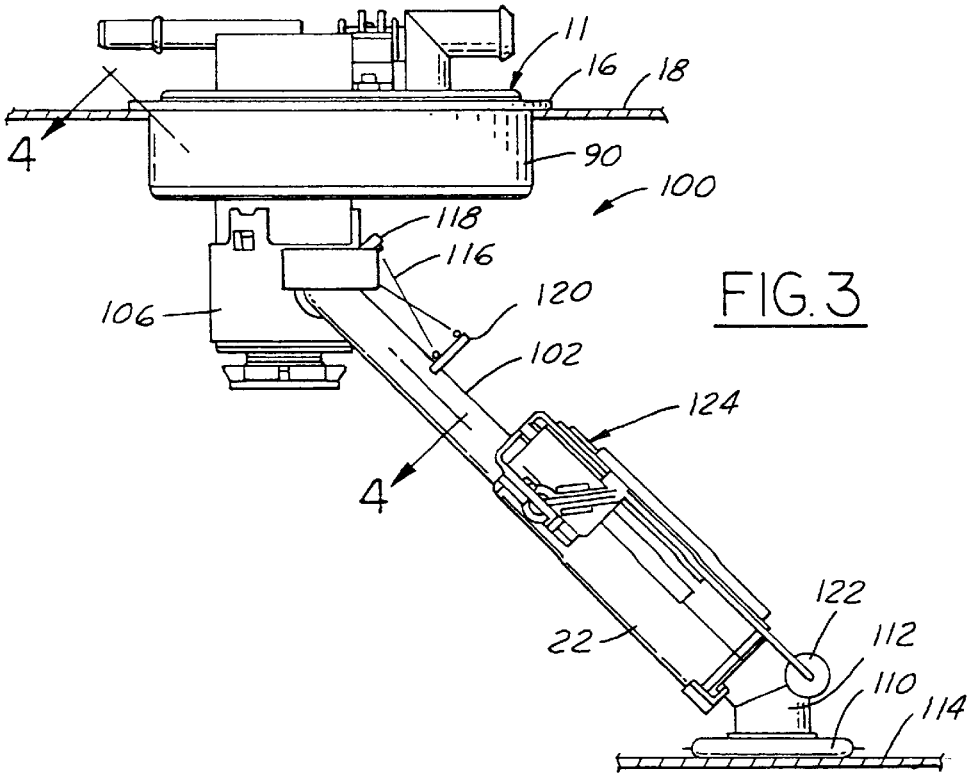
FIG. 3 is a side view of a modified fuel filter and fuel pressure regulator module.

A modified fuel filter and fuel pressure regulator module 100 is shown in FIGS. 3 and 4. The module 100 has an L-shaped conduit 102 with an internal passage 104 communicating the outlet of the fuel pump 22 with a housing 106 which carries the fuel filter 14 and fuel pressure regulator 28 as in the first embodiment. The conduit 102 is rotatably received in an opening 108 in the housing 106 to permit rotation of the conduit 102 and fuel pump 22 to vary their position. To rotate the conduit 102 and fuel pump 22 to bias a fuel filter 110 and the fuel pump inlet 112 against a bottom wall 114 of the fuel tank 18, a spring 116 is provided between projections 118,120 on the housing 106 and conduit 102, respectively. This "bottom referencing" system yieldably biases the fuel filter 110 and fuel pump inlet 112 on the bottom 114 of the fuel tank 18 and accommodates variations in dimensions between similar fuel tanks and permits the module to be used in different style or sizes of fuel tanks.

The module 100 functions in substantially the same manner as the module 10 to filter fuel discharged from the fuel pump 22 and to control the pressure of fuel delivered to the engine. The module body 11, fuel filter 14 and fuel pressure regulator 28 are substantially the same as in the module 10. Desirably, a fuel level float 122 and electronic indicator assembly 124 may be connected to the module if desired.

What is claimed is:

1. A fuel pressure regulator and fuel filter module for filtering and controlling the pressure of fuel delivered from a fuel pump within a fuel tank to an engine comprising:

a one-piece body having a radially extending flange constructed to be sealed to the fuel tank;

a depending annular skirt integral with the body at one end and open at its other end;

an annular fuel filter received in the skirt and having a generally cylindrical wall defining an open interior of the filter;

a fuel supply passage formed in the body and having an inlet in communication with the fuel pump and an outlet in communication with the fuel filter, a fuel outlet passage formed in the body and having an inlet communicating with the fuel filter and an outlet adapted to communicate with the interior of the filter and with a fuel line through which fuel is delivered to the engine, the fuel filter being disposed between the supply passage and the outlet passage;

a fuel pressure regulator having an inlet in communication with the fuel outlet passage and a bypass outlet which fuel delivered from the fuel pump in excess of the engine's fuel demand is returned to the fuel tank whereby fuel is supplied under pressure from the fuel pump to the fuel supply passage whereupon the fuel flows through the fuel filter and is communicated with the fuel outlet passage and with the inlet of the fuel pressure regulator which discharges excess fuel into the fuel tank through the bypass outlet corresponding to the engine's fuel demand and the one-piece body substantially prevents the escape of fuel vapors to the atmosphere through the module.

2. The module of claim 1 wherein the filter is annular and the fuel pressure regulator and the fuel outlet passage communicate with the interior of the filter.

3. The module of claim 1 which also comprises a housing enclosing the fuel pressure regulator and connected to the skirt to close the open end of the skirt and define an enclosure therewith with the filter received in the enclosure.

4. The module of claim 1 wherein the inlet of the fuel supply passage is disposed within the fuel tank and the outlet of the fuel outlet passage is disposed outside of the fuel tank.

5. The module of claim 3 wherein the enclosure defines in part the fuel supply passage.

6. The module of claim 1 which also comprises an annular depending rim constructed to be received in an opening through a wall of the fuel tank to locate the module adjacent the fuel tank.

7. The module of claim 2 wherein the outlet of the fuel supply passage communicates with the exterior of the filter so that fuel discharged from the fuel pump flows through the filter from its exterior to its interior before entering the regulator and before being discharged through the fuel outlet passage.

8. The module of claim 1 wherein the fuel supply passage is rotatably connected to the skirt.

9. The module of claim 8 wherein the fuel supply passage is biased to dispose an inlet of the fuel pump adjacent to a bottom wall of the fuel tank.

10. The module of claim 1 wherein the body, skirt, fuel supply passage and fuel outlet passage are made in one homogeneously integral piece of an acetal plastic material substantially impervious to permeation of fuel vapors.

11. A system for supplying fuel to an engine comprising:

a fuel tank constructed to contain a supply of fuel and having an opening therethrough;

a fuel pump disposed within the fuel tank and having an inlet into which fuel is drawn from the fuel tank and an outlet through which fuel is discharged under pressure;

a fuel pressure regulator and fuel filter module at least partially received in the fuel tank through the opening and having an integral peripheral flange sealingly connected to the fuel tank, an integral depending skirt having free end, an annular fuel filter received in the skirt with a generally cylindrical wall defining an interior of the filter, an integral fuel supply passage having an inlet in communication with the fuel pump outlet and an outlet in communication with the fuel filter, an integral fuel outlet passage having an inlet communicating with the fuel filter and an outlet adapted to communicate with the interior of the filter and with a fuel line through which fuel is delivered to the engine, the filter is disposed between the outlet of the fuel supply passage and the inlet of the outlet passage, and a fuel pressure regulator attached to and closing the free end of the skirt and having an inlet in communication with the fuel outlet passage and a bypass outlet through which fuel delivered from the fuel pump in excess of the engine's fuel demand is returned to the fuel tank whereby the fuel pressure regulator and fuel filter module encloses the opening in the fuel tank and substantially eliminates the escape to the atmosphere of fuel vapors through the module.

12. The system of claim 11 wherein the filter is annular and the fuel pressure regulator and the fuel outlet passage communicate with the interior of the filter.

13. The system of claim 11 which also comprises a housing enclosing the fuel pressure regulator and connected to the skirt to close the free end of the skirt and define an enclosure therewith with the filter received in the enclosure.

14. The system of claim 11 wherein the inlet of the fuel supply passage is disposed within the fuel tank and the outlet of the fuel outlet passage is disposed outside of the fuel tank.

15. The system of claim 13 wherein the enclosure defines in part the fuel supply passage.

16. The system of claim 11 which also comprises an annular depending rim constructed to be received in an opening through a wall of the fuel tank to locate the module adjacent the fuel tank.

17. The system of claim 12 wherein the inlet of the fuel supply passage communicates with the exterior of the filter so that fuel discharged from the fuel pump flows through the filter from its exterior to its interior before either entering the regulator or being discharged through the fuel outlet passage.

18. The system of claim 11 wherein the body, skirt, fuel supply passage and fuel outlet passage are made in one homogeneously integral piece of an acetal plastic material substantially impervious to permeation of fuel vapors.

19. The system of claim 18 wherein the fuel tank is made in one homogeneously integral piece of a plastic material.

20. The system of claim 11 wherein the fuel supply passage is rotatably connected to the skirt.

21. The system of claim 20 wherein the fuel supply passage is biased to dispose an inlet of the fuel pump adjacent to a bottom wall of the fuel tank.

* * * * *

UNITED STATES PATENT AND TRADEMARK OFFICE

CERTIFICATE OF CORRECTION

PATENT NO. : 6,155,238
DATED : December 5, 2000
INVENTOR(S) : Paul F. Briggs, George H. Bucci, David R. Mroczka It is certified that error appears in the above-identified patent and that said Letters Patent is hereby corrected as shown below:

Column 6,
Line 51, after "having" insert -- a --.

Signed and Sealed this

Twenty-sixth Day of February, 2002

*Attest:*

*Attesting Officer*

JAMES E. ROGAN
*Director of the United States Patent and Trademark Office*